US007588092B2

(12) United States Patent
Liebl

(10) Patent No.: US 7,588,092 B2
(45) Date of Patent: Sep. 15, 2009

(54) EXTERNAL ENDPLATE GUSSETING FOR MATERIAL PUSHING ATTACHMENT

(75) Inventor: John G. Liebl, Atwater, MN (US)

(73) Assignee: Clark Equipment Company, West Fargo, ND (US)

( * ) Notice: Subject to any disclaimer, the term of this patent is extended or adjusted under 35 U.S.C. 154(b) by 216 days.

(21) Appl. No.: 11/542,724

(22) Filed: Oct. 4, 2006

(65) Prior Publication Data

US 2008/0098627 A1 May 1, 2008

(51) Int. Cl.
*E02F 3/76* (2006.01)

(52) U.S. Cl. ..... 172/817; 172/811; 37/266; 37/281

(58) Field of Classification Search ..... 172/810, 172/811, 815, 816, 817, 827, 828, 832; 37/233, 37/266, 270, 280
See application file for complete search history.

(56) References Cited

U.S. PATENT DOCUMENTS

| | | | | | |
|---|---|---|---|---|---|
| 1,579,388 | A | | 4/1926 | Palmer | |
| 3,605,167 | A | * | 9/1971 | Martel et al. | 15/236.05 |
| 4,275,514 | A | * | 6/1981 | Maura | 37/281 |
| 4,707,936 | A | * | 11/1987 | Steinhoff | 37/264 |
| 4,999,022 | A | | 3/1991 | Veys | |
| 5,265,355 | A | | 11/1993 | Daniels | 37/231 |
| 5,285,588 | A | | 2/1994 | Niemela et al. | 37/234 |
| 5,392,538 | A | | 2/1995 | Geerligs et al. | 37/268 |
| 5,724,755 | A | | 3/1998 | Weagley | 37/233 |
| 5,819,444 | A | | 10/1998 | Desmarais | |
| 5,894,689 | A | * | 4/1999 | Turk | 37/281 |
| 6,112,438 | A | | 9/2000 | Weagley | 37/270 |
| 6,298,585 | B1 | * | 10/2001 | Boulet | 37/281 |
| 6,470,604 | B1 | | 10/2002 | Foster et al. | 37/267 |
| 6,560,904 | B2 | | 5/2003 | Guggino | 37/233 |
| 6,845,576 | B2 | | 1/2005 | Vennard et al. | 37/266 |
| D511,174 | S | | 11/2005 | Fatemi | D15/11 |
| 7,131,221 | B2 | * | 11/2006 | Schmeichel | 37/231 |
| 7,360,327 | B2 | * | 4/2008 | Osgood et al. | 37/444 |
| 2003/0061741 | A1 | | 4/2003 | Guggino | |
| 2005/0097786 | A1 | | 5/2005 | Vennard et al. | 37/266 |
| 2005/0126051 | A1 | | 6/2005 | Fatemi | 37/266 |

OTHER PUBLICATIONS

European Search Report dated Feb. 12, 2008 for European patent application 07 11 7197.

* cited by examiner

*Primary Examiner*—Thomas B Will
*Assistant Examiner*—Joel F. Mitchell
(74) *Attorney, Agent, or Firm*—John D. Veldhuis-Kroeze; Westman, Champlin & Kelly, P.A.

(57) ABSTRACT

An attachment configured to be attached to a power machine is disclosed. The attachment includes a blade having opposing first and second major surfaces and first and second edges. The attachment has first and second end plates each having opposing inner and outer surfaces. The end plates are fixedly attached to the first and second edges of the blade. The inner surfaces of the first and second end plates are positioned adjacent to and extend from the first major surface of the blade. The attachment further includes a support structure coupled to the blade. The support structure includes a first support member fixedly attached to and extending from both the second major surface of the blade and the outer surface of the first end plate.

11 Claims, 4 Drawing Sheets

EXTERNAL ENDPLATE GUSSETING FOR MATERIAL PUSHING ATTACHMENT

BACKGROUND

Power machines, such as skid steer loaders, mini-excavators, wheel loaders, and the like, often have utility attachments coupled to them to perform certain tasks. For example, a power machine may be equipped with a bucket, a post-hole auger, a grader, a planer, or any one of a variety of other different types of attachments. One other particular type of attachment is a material pushing attachment. Such attachments can push material such as snow for the purpose of removing the material from a particular area. For example, a power machine equipped with a material pushing attachment can be used to clear a parking lot covered in snow after a snowfall. Other materials besides snow, of course, can be pushed by such an attachment to move it out of a particular area.

Attachments of this type typically have a blade or moldboard that engages the material to push it to a desired location. The moldboard typically has a concave surface to encourage material that might ride up onto the moldboard to roll forward in front of the attachment instead of over the top of the attachment. In addition, these types of attachments may have end plates attached to the moldboard to provide a defined width of material that is pushed by the attachment on one given pass over the area to be cleared by the power machine and to provide structural support for the moldboard. To prevent deformation or fatigue related damage to the moldboard, it is desirable to provide reinforcement for the moldboard.

SUMMARY

One illustrative embodiment is directed toward an attachment that is configured to be attached to a power machine. The attachment includes a blade having opposing first and second major surfaces and first and second edges. The attachment further includes first and second end plates. Each of the first and second end plates have opposing inner and outer surfaces fixedly attached to the first and second edges of the blade. The inner surfaces of the first and second end plates are positioned adjacent to and extend from the first major surface of the blade. The attachment also includes a support structure coupled to the blade and including a first support member fixedly attached to and extending from the second major surface of the blade and the outer surface of the first end plate.

Another illustrative is directed toward an attachment configured to push material. The attachment includes a moldboard having opposing first and second major surfaces and first and second ends. The attachment further includes a plate that is attached to the moldboard and extends distally from the moldboard. A coupling structure extends proximally from the second major surface of the moldboard. A bracket is fixedly coupled to the second major surface of the moldboard and a portion of the plate that is positioned distally from the first major surface of the moldboard.

Still another embodiment is directed toward a loader having a frame and lift arms pivotally mounted to the frame. The lift arms have an interface member pivotally coupled to the thereto and are configured to accept an attachment thereon. The attachment includes a horizontally extending member with first and second ends. An endplate is attached to the first end of the horizontally extending surface. The endplate has an inner surface adjacent the horizontally extending member and an outer surface opposite the inner surface. A bracket is attached to the horizontally extending member and the outer surface of the end plate.

BRIEF DESCRIPTION OF THE DRAWINGS

The concepts presented herein will be further explained with reference to the attached figures, wherein like structure or system elements can be referred to by like reference numerals throughout the several views.

While the above-identified figures set forth one or more illustrative embodiments, other embodiments are also contemplated, as noted herein. In all cases, concepts presented herein describe the embodiments by way of representation and not by limitation. It should be understood that numerous other modifications and embodiments can be devised by those skilled in the art which fall within the scope and spirit of the principles of the discussion herein.

DETAILED DESCRIPTION

Figure 1:
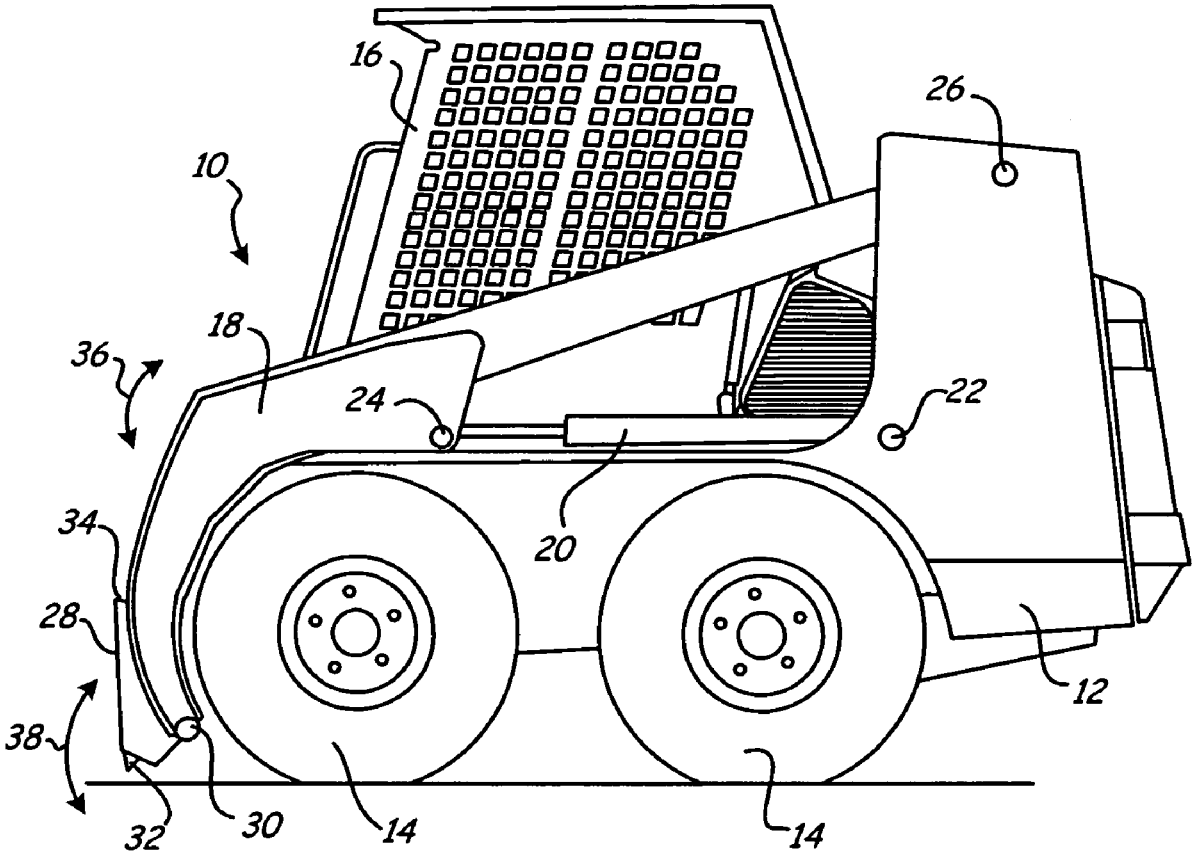
FIG. 1 is a side elevation view of a power machine of the type suitable for use with an attachment of the typed discussed herein.

FIG. 1 illustrates a power machine 10 of the type that is useful for employing an attachment of the current disclosure. Power machine 10 includes a frame 12 that is supported by wheels 14. Power machine 10 has an engine (not shown), which supplies power to the wheels 14 causing the power machine to move under the control of an operator. Frame 12 supports a cab 16, which defines an operating compartment. An operator can sit inside the cab 16 and control the power machine 10.

Power machine 10 further includes a lift arm 18, which is coupled to the frame 12 at pivot point 26. Actuator 20 is coupled to the frame 12 at first pivot point 22 and the lift arm 18 at second pivot point 24. In one illustrative embodiment, actuator 20 is a hydraulic cylinder. A single lift arm 18 is shown in FIG. 1, but it is to be understood that a similar lift arm and corresponding actuator may be positioned on the opposite side of the cab and similarly attached to the frame 12.

By extending or retracting the actuator 20, the lift arm 18 can be raised or lowered in the general direction shown by arrow 36. The actual path of motion of the lift arm 18 may vary. For example, the path of motion can be a generally radial path as shown as by arrow 36. Alternative lift arms and geometrical relationships between the lift arm actuator, and frame can result in other paths of motion for the lift arm. For example, the lift arm 18 can raise and lower in a generally vertical path.

Power machine 10 further includes an attachment interface 28, which is rotatably coupled to the lift arm 18 about attachment point 30. One or more tilt actuators (not shown) are coupled to the attachment interface 28 to cause the attachment interface to rotate about attachment point 30 in a direction shown by arrow 38. Attachment interface 28 further includes an edge 34, which is configured to engage a mount on an attachment. In addition, the attachment interface 28 includes one or more retractable pins 32 (shown in an extended position in FIG. 1). The pins 32 can be extended or retracted so that when the mount of an attachment is engaged with the edge 34 the pins 32 can extend into apertures in the attachment to secure the attachment to the power machine 10. Details of the attachment features that engage both the edge 34 and the pins 32 will be described in more detail below.

The power machine 10 shown in FIG. 1 is a skid steer loader. However, it should be appreciated that the attachments discussed below are capable of interfacing with a number of different types of power machines. For example, the power machine 10 can be a mini excavator, wheeled or tracked loader, utility vehicle, all-wheel steer loader, or a walk behind loader, to name a few.

Figure 2:
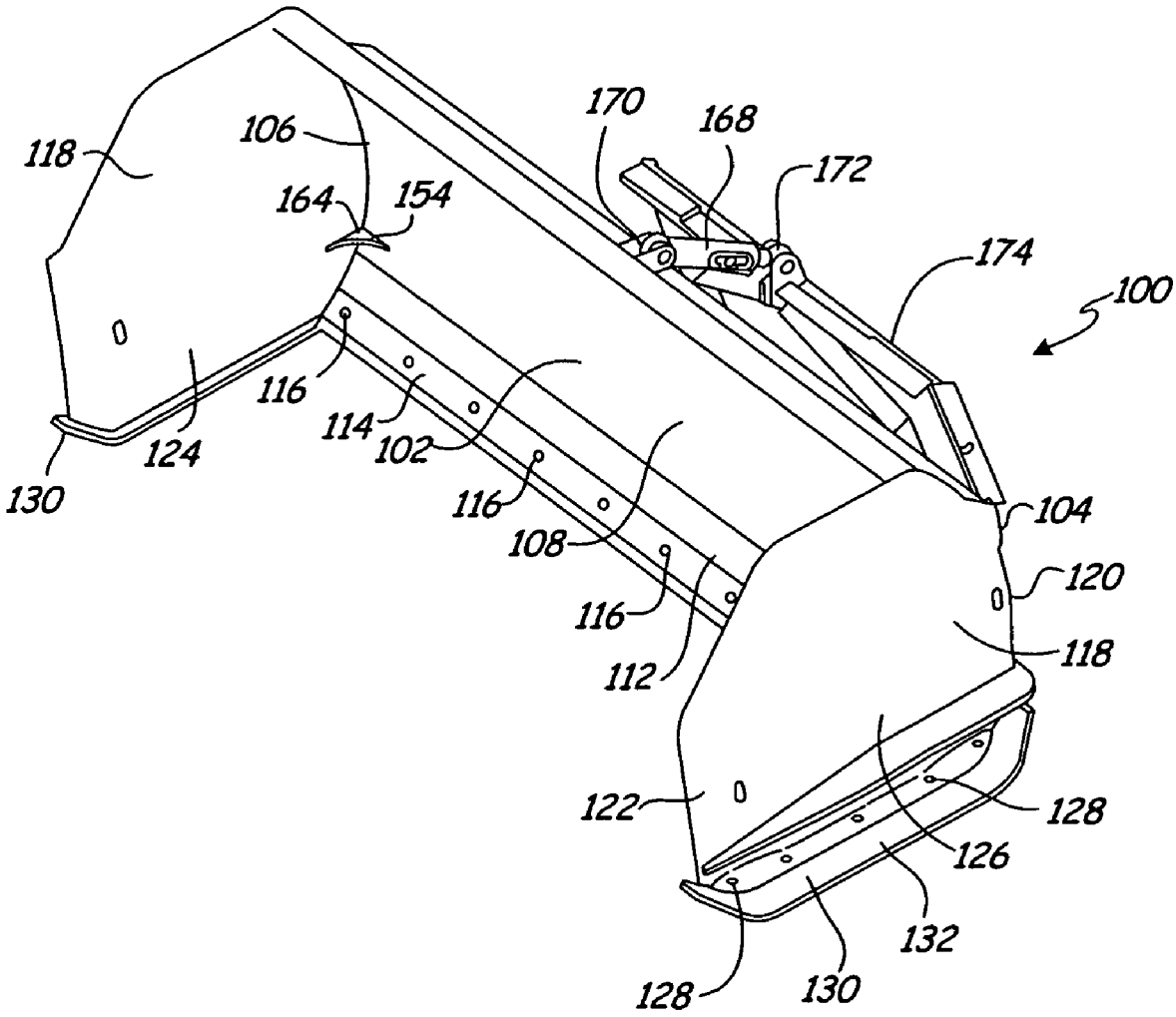
FIG. 2 is a perspective view of a material pushing attachment having a moldboard with attached endplates and a reinforcement member attached to each shown along a first major surface the moldboard according to one embodiment.
Figure 3:
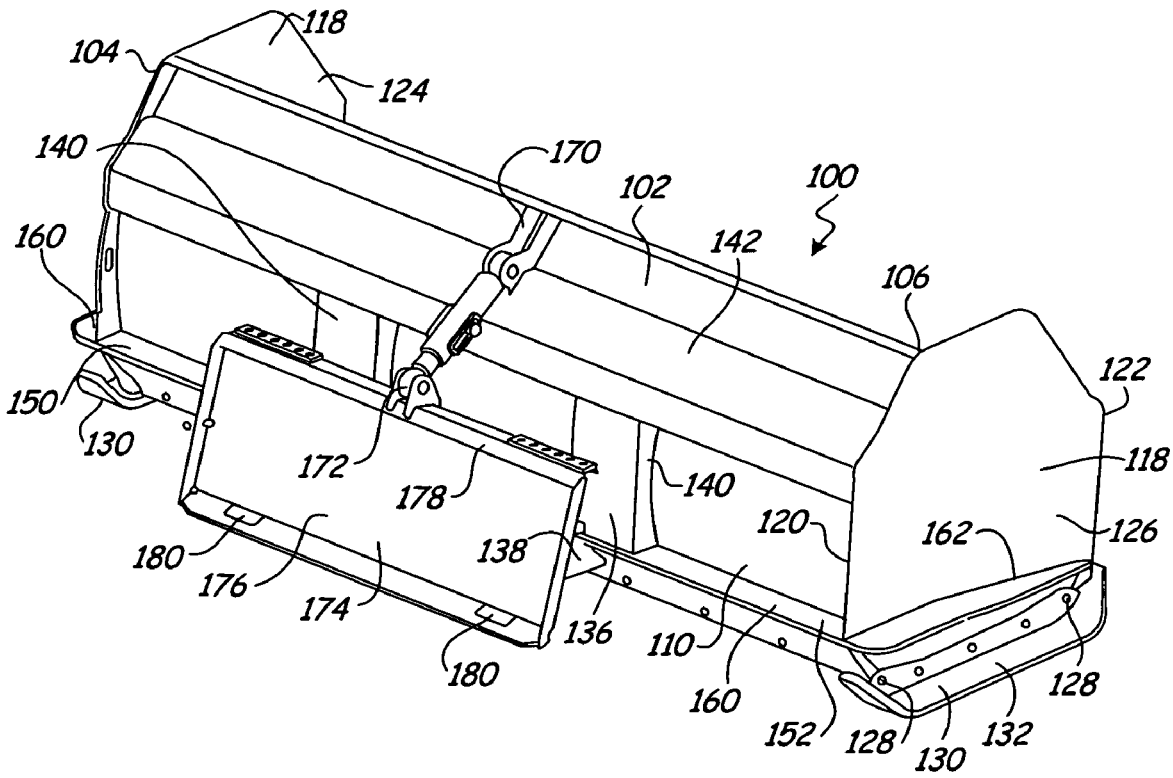
FIG. 3 is a perspective view of the attachment of FIG. 2 viewed along a second major surface of the moldboard.
Figure 4:
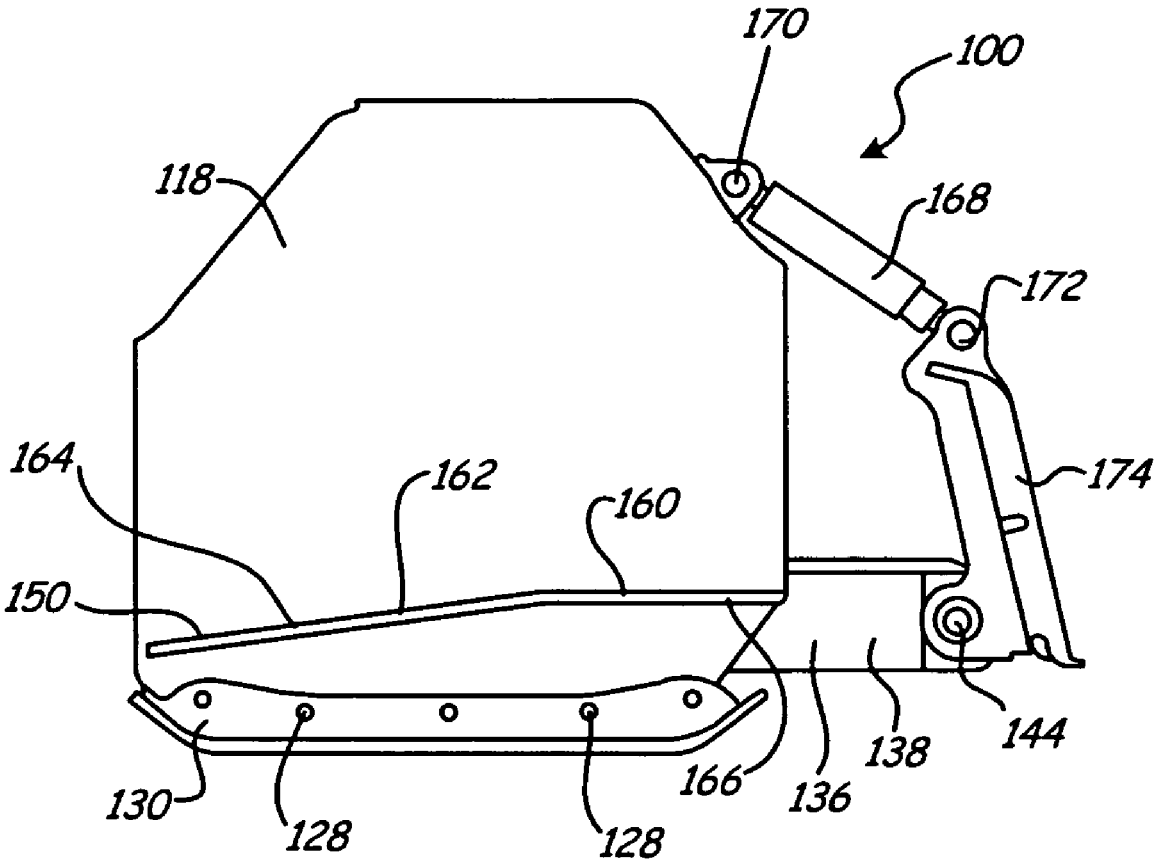
FIG. 4 is a side elevation view of the attachment of FIG. 2.

FIGS. 2-4 illustrate an attachment 100 configured to be attached to power machine 10 according to one illustrative embodiment. Attachment 100 includes a blade or moldboard 102 that extends transversely from a first end 104 to a second end 106 with respect to power machine 10 when attached thereto. Moldboard 102 has a generally concave first major surface 108 and an opposing generally convex second major surface 110. Moldboard 102 is configured so that the first major surface 108 is positioned to engage material and push it. For example, attachment 100 can be used to push snow, debris, or any number of different types of material that is desirably repositioned.

A cutting edge 114 is positioned along and attached to a lateral edge 112 of the moldboard 102. The cutting edge 114 is shown as being attached to the moldboard 102 with a plurality of fasteners 116. Thus, the cutting edge 114 is replaceable with respect to the moldboard 102. Alternatively, the cutting edge 114 can be permanently attached to the moldboard 102 such as by being welded along the lateral edge 112 of the moldboard 102. Alternatively still, attachment 100 can have a moldboard 102 that does not have a cutting edge 114 attached to it.

Attachment 100 further includes a pair of end plates 118. The end plates 118 are attached to the first end 104 and the second end 106 of the moldboard 102 at a proximal end 120 of each of the respective end plates 118. Thus, the end plates 118 extend distally from the first major surface 108 of the moldboard 102 toward a distal end 122 of the end plates 118. Each of the end plates 118 has an inner surface 124 that is positioned to be facing the moldboard 102 when the end plates 118 are attached to the moldboard 102. In addition, each end plate 118 has an outer surface 126 that opposes the inner surface 124.

A pair of skid plates 130 are attached to each of the end plates 118. Each of the skid plates 130 has a base 132 that is positioned generally in a normal attitude with respect to the end plates 118. The base 132 provides an engagement surface for the attachment 100. Thus, for example, as attachment 100 is moved by power machine 10 over a terrain, the skid plate 130 is configured to engage the terrain when the attachment is in a lowered position. Skid plates 130 are, in one illustrative embodiment, fastened to the end plates 118 with a plurality of fasteners 128. Thus, the skid plates 130 can be removable. This allows a user to replace the skid plates 130 when they become worn and thereby prevent other portions of the attachment 100 from wearing because of engagement with any surface that the attachment 100 may contact.

Attachment 100 includes a support structure 136. Support structure 136 is coupled to the moldboard 102. In the illustrative embodiment, the support structure 136 includes a base 138, which is attached to the moldboard 102 and projects proximally from the moldboard 102. A pair of vertical support members 140 extend vertically from the base 138 and are similarly attached to the second major surface 110 of moldboard 102. The support structure 136 also includes a cross member 142, which extends along a substantial, if not the entire, transverse length of the second major surface 110 of the moldboard 102. The cross member 142 is attached to the moldboard 102, such as by welding, and is also attached to the vertical support members 140. In addition, the cross member 142 is attached to each of the end plates 118.

The base 138 of support structure 136 has a pivot mount 144. The pivot mount 144 provides a pivotable attachment point between an interface mount 174 and the support structure 136. Mount 174 is configured to be attached to power machine 10 at the attachment interface 28 shown in FIG. 1. Interface mount 174 has a major surface 176, which is configured to be positioned against the attachment interface 28 on the power machine 10 (shown in FIG. 1). In addition, the interface mount 174 includes a lip 178 and apertures 180. The lip 178 is configured to engage the edge 34 of the attachment interface 28. When the edge 34 and the lip 178 are engaged, and the major surface 176 of the interface mount 174 is positioned adjacent the attachment interface 28 so that the pins 32 are aligned with the apertures 180, pins 32 can be extended into the apertures 180 to securely hold the attachment 100. An actuator 168 is positioned between and attached to a moldboard attachment point 170 and a mount attachment point 172. When the actuator 168 is actuated, the support structure 136 pivots with respect to the mount 174.

Support structure 136 also includes a first reinforcement member 150 and a second reinforcement member 152. The first reinforcement member 150 extends along a portion of the second major surface 110 of the moldboard 102. In addition, the first reinforcement member 150 extends along, and is attached to, a portion of the outer surface 126 of the end plate 118 and the first end 104 of moldboard 102. Similarly, the second reinforcement member 152 extends along a portion of the second major surface 110 of the moldboard 102. The second reinforcement member 152 also extends along, and is attached to, the outer surface 126 of the end plate 118 and the second end 106 of moldboard 102.

Each of the first and second reinforcement members 150 and 152 is fixedly attached or secured to the moldboard 102 and its respective end plate 118. In addition, a portion of each of the first and second reinforcement members 150 and 152 extends through each of the end plates 118 and a moldboard 102. For example, slots (not shown) may be formed in each of the end plate 118 and moldboard 102 to allow the members 150 and 152 to extend through them. The portion 154 of each of the first and second reinforcement members 150 and 152 that extends through the moldboard 102 and end plates 118 is attached to the moldboard 102 and its respective end plate 118 along the first major surface of 108 of a moldboard 102 and the inner surface 124 of the end plate 118. This attachment can be accomplished such as by a weld at an edge 164. Alternatively, the members 150 and 152 can be positioned so that they do not extend through either of the end plates 118 or the moldboard 102. In that case, the members 150 and 152 would engage, and be attached to, only the outer surface 126 of one of the end plates 118 and the second major surface 110 of the moldboard 102.

In one illustrative embodiment, each of the first reinforcement member 150 and the second reinforcement member 152 has a first portion 160 and a second portion 162. The first portion 160 and the second portion 162 are shown as being integrally joined together to provide a single, unitary piece of material, although alternatively the first and second portions can be two separate pieces of material that are attached to each other.

The first portion 160 is a generally flat piece of material, which extends along the second major surface 110 of the moldboard 102 and is attached to the moldboard along an edge of the flat surface. The first portion 160 of the first and second reinforcement members 150 and 152 includes, in one embodiment, the portion 154 that extends from the inner surface 124 of the end plate 118 and the first major surface 108 of the moldboard 102. The second portion 162 of each of the first and second reinforcement members 150 and 152 extends distally from the first portion 160 and can depart from the planarity of the first portion 160 at any angle. The second portion 162 is likewise attached to the outer surface 126 of the respective end plates 118 along an edge of the second portion, thereby creating a pair of legs 164 and 166, attached to the end plate 118, that are non-planar with respect to each other.

The first and second reinforcement members 150 and 152 extend transversely that, is, in a lateral direction, away from the outer surfaces 126 of their respective end plates 118. However, in one illustrative embodiment, the lateral extension of each of the first and second reinforcement members 150 and 152 is limited so that it is within the lateral extension of the skid plates 130. Thus, the attachment can be maneuvered into areas unencumbered by the lateral extension of the first and second reinforcement members 150 and 152. It should be appreciated that although the first and second reinforcement members 150 and 152 are shown as a unitary piece of material, alternatively they can be made of two or more pieces of material that are attached together. Alternatively still, the first and second reinforcement members 150 and 152 can be made of a single unitary piece of material. Alternatively still, the first and second reinforcement members 150 and 152 can include at least the first and second portions 160 and 162 that are not attached to each other.

The embodiments described herein provide several advantages. The support structure reduces the possibility of a structural failure of the attachment. In addition, the attachment has a generally smooth first major surface of the moldboard. This encourages material being pushed by the attachment to roll forward without significant obstruction as opposed to potentially sticking on the attachment. Further, the lateral extension of the reinforcing members are contained within the lateral extension of the skid plates, thereby allowing the attachment to maneuver in tight areas without being limited by the reinforcing members.

Although the discussion has been focused upon illustrative embodiments, workers skilled in the art will recognize that changes may be made in form and detail without departing from the spirit and the scope of the discussion.

What is claimed is:

1. An attachment configured to be attached to a power machine, comprising:

a blade having opposing first and second major surfaces and first and second edges;

first and second end plates each having opposing inner and outer surfaces fixedly attached to the first and second edges of the blade so that the first and second end plates are generally incapable of rotational movement with respect to the blade with the inner surfaces of the first and second end plates positioned adjacent to and extending from the first major surface of the blade; and a support structure, coupled to the blade and including a first support member having a unitary piece of material that is fixedly attached to and extending from both the second major surface of the blade and the outer surface of the first end plate.

2. The attachment of claim 1, wherein the first support member extends through the blade and is attached to the inner surface of the first end plate.

3. The attachment of claim 1, further comprising a skid plate attached to the first end plate, the skid plate extending away from the outer surface of the first end plate in a direction that is generally normal to the outer surface of the first end plate, wherein the skid plate extends at least as far in the direction as the first support member.

4. The attachment of claim 3, wherein the skid plate is removably attached to the first end plate.

5. The attachment of claim 1, wherein the first support member has a first portion that is generally planar and a second portion that non-planar with respect to from the generally planar first portion.

6. The attachment of claim 5, wherein the first portion of the first support member is attached to the blade and the outer surface of the first end plate.

7. The attachment of claim 6, wherein the second portion of the first support member is attached to the outer portion of the first end plate.

8. The attachment of claim 5, wherein the first portion and the second portion are made from a unitary piece of material.

9. The attachment of claim 1, wherein the support structure includes a second support member fixedly attached to and extending from the second major surface of the blade and the outer surface of the second end plate.

10. The attachment of claim 9, wherein the first support member and the second support member are formed from a single unitary piece of material.

11. A loader having a frame and lift arms pivotally mounted to the frame, the lift arms having an interface member pivotally coupled to the thereto and configured to accept an attachment thereon, the attachment comprising:

a horizontally extending member with first and second ends;

an endplate fixedly attached to the first end of the horizontally extending member so that the endplate is generally incapable of rotational movement with respect to the member, the endplate having an inner surface adjacent the horizontally extending member and an outer surface opposite the inner surface; and a bracket with a unitary piece of material that is fixedly attached to both the horizontally extending member and the outer surface of the end plate.

* * * * *